US009249581B2

(12) United States Patent
Nilsson et al.

(10) Patent No.: US 9,249,581 B2
(45) Date of Patent: Feb. 2, 2016

(54) RESILIENT FLOOR

(71) Applicant: VÄLINGE INNOVATION AB, Viken (SE)

(72) Inventors: Mats Nilsson, Viken (SE); Per Nygren, Ramlosa (SE)

(73) Assignee: VALINGE INNOVATION AB, Viken (SE)

( * ) Notice: Subject to any disclaimer, the term of this patent is extended or adjusted under 35 U.S.C. 154(b) by 0 days.

(21) Appl. No.: 14/272,895

(22) Filed: May 8, 2014

(65) Prior Publication Data

US 2014/0237924 A1 Aug. 28, 2014

Related U.S. Application Data

(63) Continuation of application No. 13/734,406, filed on Jan. 4, 2013, now Pat. No. 8,756,899, which is a continuation of application No. 12/875,293, filed on Sep. 3, 2010, now Pat. No. 8,365,499.

(60) Provisional application No. 61/239,927, filed on Sep. 4, 2009.

(51) Int. Cl.

| | |
|---|---|
| ***E04F 15/10*** | (2006.01) |
| ***E04F 15/02*** | (2006.01) |
| ***E04B 5/00*** | (2006.01) |

(52) U.S. Cl.

CPC ..... *E04F 15/02038* (2013.01); *E04B 5/00* (2013.01); *E04F 15/10* (2013.01); *E04F 2201/0138* (2013.01); *E04F 2201/0146* (2013.01); *E04F 2201/0153* (2013.01); *Y10T 29/49623* (2015.01)

(58) Field of Classification Search

CPC ..... E04F 15/02038; E04F 15/10; E04F 2201/0153; E04F 2201/0146; E04F 2201/0138

USPC ..... 52/582.2, 591.1, 592.1, 592.4, 745.2, 52/747.1, 747.11

See application file for complete search history.

(56) References Cited

U.S. PATENT DOCUMENTS

| | | | |
|---|---|---|---|
| 213,740 | A | 4/1879 | Connor |
| 1,018,987 | A | 2/1912 | Philpot et al. |
| 1,361,501 | A | 12/1920 | Schepmoes |
| 1,394,120 | A | 10/1921 | Rockwell |
| 1,723,306 | A | 8/1929 | Sipe |
| 1,743,492 | A | 1/1930 | Sipe |

(Continued)

FOREIGN PATENT DOCUMENTS

| | | |
|---|---|---|
| CA | 1 237 344 | 5/1988 |
| CA | 2 252 791 A1 | 5/1999 |

(Continued)

OTHER PUBLICATIONS

U.S. Appl. No. 14/224,628, Boo.

(Continued)

*Primary Examiner* — Adriana Figueroa

(74) *Attorney, Agent, or Firm* — Buchanan Ingersoll & Rooney P.C.

(57) ABSTRACT

A method of assembling resilient floorboards is disclosed that includes the step of bending an edge of a floorboard during the assembling. The bending reduces the force required for connection of the edge to another edge of a juxtaposed floorboard.

20 Claims, 9 Drawing Sheets

(56) References Cited

U.S. PATENT DOCUMENTS 1,787,027 A 12/1930 Wasleff
1,925,070 A 8/1933 Livezey
1,946,646 A 2/1934 Storm
1,946,690 A 2/1934 Haines
2,015,813 A 10/1935 Nielsen
2,088,238 A 7/1937 Greenway
2,089,075 A 8/1937 Siebs
2,142,305 A 1/1939 Davis
2,204,675 A 6/1940 Grunert
2,266,464 A 12/1941 Kraft
2,303,745 A 12/1942 Karreman
2,306,295 A 12/1942 Casto
2,355,834 A 8/1944 Webb
2,497,837 A 2/1950 Nelson
2,740,167 A 4/1956 Rowley
2,769,726 A 11/1956 Wetterau et al.
2,818,895 A 1/1958 Zuber
2,872,712 A 2/1959 Brown
2,947,040 A 8/1960 Schultz
3,055,461 A 9/1962 De Ridder
3,087,269 A 4/1963 Hudson
3,120,083 A 2/1964 Dahlberg et al.
3,247,638 A 4/1966 Gay et al.
3,259,417 A 7/1966 Chapman
3,310,919 A 3/1967 Bue et al.
3,397,496 A 8/1968 Sohns
3,436,888 A 4/1969 Ottosson
3,538,665 A 11/1970 Gohner
3,554,850 A 1/1971 Kuhle
3,578,548 A 5/1971 Wesp
3,619,963 A 11/1971 Omholt
3,623,288 A 11/1971 Horowitz
3,657,852 A 4/1972 Worthington et al.
3,694,983 A 10/1972 Couquet
3,760,547 A 9/1973 Brenneman
3,857,749 A 12/1974 Yoshida
3,883,258 A 5/1975 Hewson
3,937,861 A 2/1976 Zuckerman et al.
3,946,529 A 3/1976 Chevaux
3,950,915 A 4/1976 Cole
4,023,596 A 5/1977 Tate
4,037,377 A 7/1977 Howell et al.
4,100,710 A 7/1978 Kowallik
4,169,688 A 10/1979 Toshio
4,170,859 A 10/1979 Counihan
4,176,210 A 11/1979 Skinner
4,226,064 A 10/1980 Kraayenhof
4,242,390 A 12/1980 Nemeth
4,296,017 A 10/1981 Weissgerber et al.
4,299,070 A 11/1981 Oltmanns et al.
4,312,686 A 1/1982 Smith et al.
4,315,724 A 2/1982 Taoka et al.
4,426,820 A 1/1984 Terbrack
4,454,699 A 6/1984 Strobl
4,489,115 A 12/1984 Layman et al.
4,512,131 A 4/1985 Laramore
4,526,418 A 7/1985 Martin
4,570,353 A 2/1986 Evans
4,574,099 A 3/1986 Nixon
4,599,841 A 7/1986 Haid
4,610,900 A 9/1986 Nishibori
4,724,187 A 2/1988 Ungar et al.
4,759,164 A 7/1988 Abendroth et al.
4,769,963 A 9/1988 Meyerson
4,788,088 A 11/1988 Kohl
4,807,412 A 2/1989 Frederiksen
4,849,768 A 7/1989 Graham
4,944,514 A 7/1990 Suiter
4,947,595 A 8/1990 Douds et al.
4,976,221 A 12/1990 Yetter
5,007,222 A 4/1991 Raymond
5,050,362 A 9/1991 Tal et al.
5,052,158 A 10/1991 D'Luzansky
5,076,034 A 12/1991 Bandy
5,112,671 A 5/1992 Diamond et al.
5,134,026 A 7/1992 Melcher
5,162,141 A 11/1992 Davey et al.
5,185,193 A 2/1993 Phenicie et al.
5,229,217 A 7/1993 Holzer
5,295,341 A 3/1994 Kajiwara
5,322,335 A 6/1994 Niemi
5,333,429 A 8/1994 Cretti
5,349,796 A 9/1994 Meyerson
5,367,844 A 11/1994 Diedrich
5,433,806 A 7/1995 Pasquali et al.
5,480,602 A 1/1996 Nagaich
5,502,939 A 4/1996 Zadok
5,503,788 A 4/1996 Lazareck et al.
5,516,472 A 5/1996 Laver
5,553,427 A 9/1996 Andres
5,613,339 A 3/1997 Pollock
5,618,602 A 4/1997 Nelson
5,642,592 A 7/1997 Andres
5,647,184 A 7/1997 Davis
5,653,099 A 8/1997 MacKenzie
5,660,016 A 8/1997 Erwin et al.
5,662,977 A 9/1997 Spain et al.
5,670,237 A 9/1997 Shultz et al.
5,671,575 A 9/1997 Wu
5,694,730 A 12/1997 Del Rincon et al.
5,706,621 A 1/1998 Pervan
5,713,165 A 2/1998 Erwin
5,724,909 A 3/1998 Pitman et al.
5,728,476 A 3/1998 Harwood
5,755,068 A 5/1998 Ormiston
5,758,466 A 6/1998 Tucker
5,777,014 A 7/1998 Hopper et al.
5,780,147 A 7/1998 Sugahara et al.
5,791,113 A 8/1998 Glowa et al.
5,797,237 A * 8/1998 Finkell, Jr. ..... 52/589.1
5,833,386 A 11/1998 Rosan et al.
5,836,128 A 11/1998 Groh et al.
5,856,389 A 1/1999 Kostrzewski et al.
5,858,160 A 1/1999 Piacente
5,863,632 A 1/1999 Bisker
5,869,138 A 2/1999 Nishibori
D406,360 S 3/1999 Finkell, Jr.
5,900,099 A 5/1999 Sweet
5,989,668 A 11/1999 Nelson et al.
6,004,417 A 12/1999 Roesch et al.
6,006,486 A 12/1999 Moriau
6,023,907 A 2/2000 Pervan
6,027,599 A 2/2000 Wang
6,029,416 A 2/2000 Anderson
6,093,473 A 7/2000 Min
6,101,778 A 8/2000 Martensson
6,139,945 A 10/2000 Krejchi et al.
6,173,548 B1 1/2001 Hamar et al.
6,189,282 B1 2/2001 Vanderwerf
6,233,899 B1 5/2001 Mellert et al.
6,260,326 B1 7/2001 Muller-Hartburg
6,314,701 B1 11/2001 Meyerson
6,324,809 B1 12/2001 Nelson
6,332,733 B1 12/2001 Hamberger et al.
6,345,481 B1 2/2002 Nelson
6,363,677 B1 4/2002 Chen
6,397,547 B1 6/2002 Martensson
6,438,919 B1 8/2002 Knauseder
6,455,127 B1 9/2002 Valtanen
6,460,306 B1 10/2002 Nelson
6,505,452 B1 1/2003 Hannig
6,536,178 B1 3/2003 Palsson et al.
6,546,691 B2 4/2003 Leopolder
6,558,070 B1 5/2003 Valtanen
6,591,568 B1 7/2003 Palsson et al.
6,617,009 B1 9/2003 Chen et al.
6,647,690 B1 11/2003 Martensson
6,671,968 B2 1/2004 Shannon
6,672,030 B2 1/2004 Schulte
6,675,545 B2 1/2004 Chen et al.
6,695,944 B2 2/2004 Courtney
6,711,869 B2 3/2004 Tychsen
6,715,253 B2 4/2004 Pervan
6,729,091 B1 5/2004 Martensson

(56) References Cited

U.S. PATENT DOCUMENTS 6,761,008 B2 7/2004 Chen et al.
6,766,622 B1 7/2004 Thiers
6,769,218 B2 8/2004 Pervan
6,769,219 B2 8/2004 Schwitte et al.
6,786,019 B2 9/2004 Thiers
6,804,926 B1 10/2004 Eisermann
6,835,421 B1 12/2004 Dohring
6,851,237 B2 2/2005 Niese et al.
6,854,235 B2 2/2005 Martensson
6,862,857 B2 3/2005 Tychsen
6,874,292 B2 4/2005 Moriau
6,880,305 B2 4/2005 Pervan et al.
6,880,307 B2 4/2005 Schwitte
6,895,881 B1 5/2005 Whitaker
6,898,911 B2 5/2005 Kornfalt et al.
6,898,913 B2 5/2005 Pervan
6,918,220 B2 7/2005 Pervan
6,922,964 B2 8/2005 Pervan
6,922,965 B2 8/2005 Rosenthal et al.
6,933,043 B1 8/2005 Son et al.
6,955,020 B2 10/2005 Moriau et al.
6,966,963 B2 11/2005 O'Connor
6,986,934 B2 1/2006 Chen et al.
7,051,486 B2 5/2006 Pervan
7,086,205 B2 8/2006 Pervan
7,090,430 B1 8/2006 Fletcher
D528,671 S 9/2006 Grafenauer
7,121,058 B2 * 10/2006 Palsson et al. ..... 52/592.2
7,127,860 B2 10/2006 Pervan et al.
7,137,229 B2 11/2006 Pervan
7,169,460 B1 1/2007 Chen et al.
7,171,791 B2 * 2/2007 Pervan ..... 52/592.1
7,211,310 B2 5/2007 Chen et al
7,275,350 B2 10/2007 Pervan et al.
7,328,536 B2 2/2008 Moriau et al.
7,337,588 B1 3/2008 Moebus
7,356,971 B2 4/2008 Pervan
7,386,963 B2 6/2008 Pervan
7,398,625 B2 7/2008 Pervan
7,419,717 B2 9/2008 Chen et al.
7,454,875 B2 11/2008 Pervan et al.
7,516,588 B2 4/2009 Pervan
7,543,418 B2 6/2009 Weitzer
7,568,322 B2 8/2009 Pervan et al.
7,584,583 B2 9/2009 Bergelin et al.
7,603,826 B1 10/2009 Moebus
7,617,651 B2 11/2009 Grafenauer
7,739,849 B2 6/2010 Pervan
7,763,345 B2 7/2010 Chen et al.
7,779,597 B2 8/2010 Thiers et al.
7,802,415 B2 9/2010 Pervan
7,856,784 B2 12/2010 Martensson
7,856,789 B2 12/2010 Eisermann
7,866,115 B2 1/2011 Pervan et al.
7,886,497 B2 2/2011 Pervan et al.
7,896,571 B1 3/2011 Hannig et al.
7,926,234 B2 4/2011 Pervan
7,930,862 B2 4/2011 Bergelin et al.
7,958,689 B2 * 6/2011 Lei ..... 52/592.1
7,980,043 B2 7/2011 Moebus
7,984,600 B2 7/2011 Alford et al.
8,021,741 B2 9/2011 Chen et al.
8,028,486 B2 10/2011 Pervan
8,033,074 B2 10/2011 Pervan et al.
8,071,193 B2 12/2011 Windmoller
8,112,891 B2 2/2012 Pervan
8,166,718 B2 5/2012 Liu
8,234,829 B2 8/2012 Thiers et al.
8,245,478 B2 8/2012 Bergelin et al.
8,293,058 B2 10/2012 Pervan et al.
8,353,140 B2 1/2013 Pervan et al.
8,356,452 B2 1/2013 Thiers et al.
8,365,499 B2 2/2013 Nilsson et al.
8,375,674 B2 2/2013 Braun
8,484,924 B2 7/2013 Braun
8,490,361 B2 7/2013 Curry et al.
8,499,521 B2 8/2013 Pervan et al.
8,511,031 B2 8/2013 Bergelin et al.
8,544,231 B2 * 10/2013 Hannig ..... 52/588.1
8,544,234 B2 10/2013 Pervan et al.
8,584,423 B2 11/2013 Pervan et al.
8,613,826 B2 12/2013 Pervan et al.
8,658,274 B2 2/2014 Chen et al.
8,683,698 B2 4/2014 Pervan et al.
8,689,512 B2 4/2014 Pervan
8,756,899 B2 6/2014 Nilsson et al.
8,800,150 B2 8/2014 Pervan
8,834,992 B2 9/2014 Chen et al.
2001/0021431 A1 9/2001 Chen
2001/0036557 A1 11/2001 Ingrim et al.
2002/0007608 A1 1/2002 Pervan
2002/0007609 A1 1/2002 Pervan
2002/0031646 A1 3/2002 Chen
2002/0046433 A1 4/2002 Sellman et al.
2002/0056245 A1 5/2002 Thiers
2002/0083673 A1 7/2002 Kettler et al.
2002/0092263 A1 * 7/2002 Schulte ..... 52/747.1
2002/0095894 A1 7/2002 Pervan
2002/0100231 A1 8/2002 Miller et al.
2002/0112429 A1 8/2002 Niese et al.
2002/0112433 A1 8/2002 Pervan
2002/0142135 A1 10/2002 Chen et al.
2002/0170257 A1 11/2002 McLain et al.
2002/0170258 A1 11/2002 Schwitte et al.
2002/0178674 A1 12/2002 Pervan
2002/0178681 A1 12/2002 Zancai
2002/0189183 A1 * 12/2002 Ricciardelli ..... 52/390
2003/0009971 A1 1/2003 Palmberg
2003/0024199 A1 2/2003 Pervan
2003/0024200 A1 2/2003 Moriau et al.
2003/0033777 A1 2/2003 Thiers et al.
2003/0101674 A1 6/2003 Pervan et al.
2003/0101681 A1 6/2003 Tychsen
2003/0154676 A1 8/2003 Schwartz
2003/0196397 A1 10/2003 Niese et al.
2003/0196405 A1 10/2003 Pervan
2004/0003888 A1 1/2004 Mott et al.
2004/0031227 A1 2/2004 Knauseder
2004/0035078 A1 2/2004 Pervan
2004/0068954 A1 4/2004 Martensson
2004/0107659 A1 6/2004 Glockl
2004/0139678 A1 * 7/2004 Pervan ..... 52/578
2004/0177584 A1 9/2004 Pervan
2004/0182036 A1 9/2004 Sjöberg et al.
2004/0206036 A1 10/2004 Pervan
2004/0211144 A1 10/2004 Stanchfield
2004/0250492 A1 12/2004 Becker
2004/0255538 A1 12/2004 Ruhdorfer
2004/0255541 A1 12/2004 Thiers et al.
2005/0003160 A1 1/2005 Chen et al.
2005/0055943 A1 3/2005 Pervan
2005/0138881 A1 6/2005 Pervan
2005/0166502 A1 8/2005 Pervan
2005/0166516 A1 8/2005 Pervan
2005/0193677 A1 9/2005 Vogel
2005/0208255 A1 9/2005 Pervan
2005/0210810 A1 9/2005 Pervan
2005/0268570 A2 12/2005 Pervan
2006/0032168 A1 2/2006 Thiers
2006/0048474 A1 3/2006 Pervan et al.
2006/0075713 A1 4/2006 Pervan et al.
2006/0099386 A1 5/2006 Smith
2006/0101769 A1 5/2006 Pervan et al.
2006/0144004 A1 7/2006 Nollet et al.
2006/0156666 A1 7/2006 Caufield
2006/0196139 A1 9/2006 Pervan
2006/0283127 A1 12/2006 Pervan
2007/0011981 A1 1/2007 Eisermann
2007/0028547 A1 2/2007 Grafenauer et al.
2007/0166516 A1 7/2007 Kim et al.
2007/0175143 A1 8/2007 Pervan et al.
2007/0175144 A1 8/2007 Hakansson
2007/0175148 A1 8/2007 Bergelin et al.
2007/0175156 A1 8/2007 Pervan et al.

(56) References Cited

U.S. PATENT DOCUMENTS

| | | | | |
|---|---|---|---|---|
| 2007/0196624 | A1 | 8/2007 | Chen et al. | |
| 2008/0000179 | A1 | 1/2008 | Pervan | |
| 2008/0000180 | A1 | 1/2008 | Pervan | |
| 2008/0000182 | A1 | 1/2008 | Pervan | |
| 2008/0000183 | A1 | 1/2008 | Bergelin et al. | |
| 2008/0000186 | A1 | 1/2008 | Pervan | |
| 2008/0000187 | A1 | 1/2008 | Pervan | |
| 2008/0000188 | A1 | 1/2008 | Pervan | |
| 2008/0000189 | A1 | 1/2008 | Pervan et al. | |
| 2008/0000194 | A1 | 1/2008 | Pervan | |
| 2008/0000417 | A1 | 1/2008 | Pervan et al. | |
| 2008/0005989 | A1 | 1/2008 | Pervan et al. | |
| 2008/0005992 | A1 | 1/2008 | Pervan | |
| 2008/0005997 | A1 | 1/2008 | Pervan | |
| 2008/0005998 | A1 | 1/2008 | Pervan | |
| 2008/0005999 | A1 | 1/2008 | Pervan | |
| 2008/0008871 | A1 | 1/2008 | Pervan | |
| 2008/0010931 | A1 | 1/2008 | Pervan | |
| 2008/0010937 | A1 | 1/2008 | Pervan | |
| 2008/0028707 | A1 | 2/2008 | Pervan | |
| 2008/0028713 | A1 | 2/2008 | Pervan | |
| 2008/0029490 | A1 | 2/2008 | Martin et al. | |
| 2008/0034701 | A1 | 2/2008 | Pervan | |
| 2008/0034708 | A1 | 2/2008 | Pervan | |
| 2008/0041007 | A1 | 2/2008 | Pervan et al. | |
| 2008/0041008 | A1 | 2/2008 | Pervan | |
| 2008/0060308 | A1 | 3/2008 | Pervan | |
| 2008/0063844 | A1 | 3/2008 | Chen et al. | |
| 2008/0066415 | A1 | 3/2008 | Pervan et al. | |
| 2008/0104921 | A1 | 5/2008 | Pervan et al. | |
| 2008/0110125 | A1 | 5/2008 | Pervan | |
| 2008/0134607 | A1 | 6/2008 | Pervan et al. | |
| 2008/0134613 | A1 | 6/2008 | Pervan et al. | |
| 2008/0134614 | A1 | 6/2008 | Pervan et al. | |
| 2008/0138560 | A1 | 6/2008 | Windmoller | |
| 2008/0172971 | A1 | 7/2008 | Pervan | |
| 2008/0241440 | A1* | 10/2008 | Bauer | 428/33 |
| 2008/0256890 | A1 | 10/2008 | Pervan | |
| 2008/0263975 | A1 | 10/2008 | Mead | |
| 2008/0311355 | A1 | 12/2008 | Chen et al. | |
| 2009/0019808 | A1 | 1/2009 | Palsson et al. | |
| 2009/0049787 | A1* | 2/2009 | Hannig | 52/589.1 |
| 2009/0133353 | A1* | 5/2009 | Pervan et al. | 52/588.1 |
| 2009/0151290 | A1 | 6/2009 | Liu | |
| 2009/0155612 | A1 | 6/2009 | Pervan et al. | |
| 2009/0193748 | A1 | 8/2009 | Boo et al. | |
| 2009/0193753 | A1 | 8/2009 | Schitter | |
| 2009/0235604 | A1 | 9/2009 | Cheng et al. | |
| 2009/0249733 | A1 | 10/2009 | Moebus | |
| 2010/0011695 | A1 | 1/2010 | Cheng et al. | |
| 2010/0242398 | A1 | 9/2010 | Cullen | |
| 2010/0260962 | A1 | 10/2010 | Chen et al. | |
| 2010/0293879 | A1 | 11/2010 | Pervan et al. | |
| 2010/0300030 | A1 | 12/2010 | Pervan et al. | |
| 2011/0030303 | A1 | 2/2011 | Pervan et al. | |
| 2011/0041996 | A1 | 2/2011 | Pervan | |
| 2011/0056167 | A1 | 3/2011 | Nilsson et al. | |
| 2011/0131901 | A1 | 6/2011 | Pervan et al. | |
| 2011/0131909 | A1 | 6/2011 | Hannig | |
| 2011/0138722 | A1 | 6/2011 | Hannig | |
| 2011/0146177 | A1 | 6/2011 | Hannig | |
| 2011/0154763 | A1 | 6/2011 | Bergelin et al. | |
| 2011/0167751 | A1 | 7/2011 | Engstrom | |
| 2011/0296780 | A1 | 12/2011 | Windmoller | |
| 2012/0003439 | A1 | 1/2012 | Chen et al. | |
| 2012/0040149 | A1 | 2/2012 | Chen et al. | |
| 2012/0124932 | A1 | 5/2012 | Schulte et al. | |
| 2012/0137617 | A1 | 6/2012 | Pervan | |
| 2012/0216472 | A1 | 8/2012 | Martensson | |
| 2012/0266555 | A1 | 10/2012 | Cappelle | |
| 2012/0279154 | A1 | 11/2012 | Bergelin et al. | |
| 2013/0014890 | A1 | 1/2013 | Pervan et al. | |
| 2013/0047536 | A1 | 2/2013 | Pervan | |
| 2013/0111758 | A1 | 5/2013 | Nilsson et al. | |
| 2013/0160391 | A1 | 6/2013 | Pervan et al. | |
| 2013/0298487 | A1 | 11/2013 | Bergelin et al. | |
| 2013/0305649 | A1 | 11/2013 | Thiers | |
| 2014/0007539 | A1 | 1/2014 | Pervan et al. | |
| 2014/0033635 | A1 | 2/2014 | Pervan et al. | |
| 2014/0069044 | A1 | 3/2014 | Wallin | |
| 2014/0115994 | A1 | 5/2014 | Pervan | |
| 2014/0283466 | A1 | 9/2014 | Boo | |
| 2014/0318061 | A1 | 10/2014 | Pervan | |
| 2014/0356594 | A1 | 12/2014 | Chen et al. | |
| 2015/0225964 | A1 | 8/2015 | Chen et al. | |

FOREIGN PATENT DOCUMENTS

| | | | |
|---|---|---|---|
| CA | 2 252 791 | C | 5/2004 |
| CN | 2076142 | U | 5/1991 |
| CN | 2106197 | U | 6/1992 |
| CN | 2124276 | U | 12/1992 |
| CN | 2272915 | | 1/1998 |
| CN | 2301491 | | 12/1998 |
| CN | 1270263 | A | 10/2000 |
| DE | 1 081 653 | | 5/1960 |
| DE | 1 534 802 | | 4/1970 |
| DE | DDR 134 967 | | 4/1979 |
| DE | 28 32 817 | A1 | 2/1980 |
| DE | 31 50 352 | A1 | 10/1982 |
| DE | 31 35 716 | A1 | 6/1983 |
| DE | 33 43 601 | A1 | 12/1983 |
| DE | 35 38 538 | A1 | 5/1987 |
| DE | 39 04 686 | C1 | 8/1989 |
| DE | 39 32 980 | A1 | 11/1991 |
| DE | 40 20 682 | A1 | 1/1992 |
| DE | 42 42 530 | A1 | 6/1994 |
| DE | 295 17 995 | U1 | 3/1996 |
| DE | 198 54 475 | A1 | 7/1999 |
| DE | 299 08 733 | U1 | 8/1999 |
| DE | 298 23 681 | U1 | 12/1999 |
| DE | 200 02 744 | U1 | 9/2000 |
| DE | 200 08 708 | U1 | 9/2000 |
| DE | 200 18 817 | U1 | 2/2001 |
| DE | 199 44 399 | A1 | 4/2001 |
| DE | 100 01 248 | A1 | 7/2001 |
| DE | 100 32 204 | C1 | 7/2001 |
| DE | 100 06 748 | A1 | 8/2001 |
| DE | 202 06 460 | U1 | 8/2002 |
| DE | 202 07 844 | U | 8/2002 |
| DE | 202 14 532 | U1 | 3/2004 |
| DE | 103 16 695 | A1 | 10/2004 |
| DE | 103 16 886 | A1 | 10/2004 |
| DE | 20 2004 014 160 | U1 | 12/2004 |
| DE | 10 2004 001 363 | A1 | 8/2005 |
| DE | 10 2004 011 531 | B3 | 11/2005 |
| DE | 198 54 475 | B4 | 6/2006 |
| DE | 10 2005 023 661 | A1 | 11/2006 |
| DE | 10 2005 024 366 | A1 | 11/2006 |
| DE | 10 2005 061 099 | A1 | 3/2007 |
| DE | 10 2006 058 655 | A1 | 6/2008 |
| DE | 10 2006 058 655 | B4 | 6/2008 |
| DE | 20 2008 011 589 | U1 | 1/2009 |
| DE | 20 2008 012 001 | U1 | 1/2009 |
| EP | 0 046 526 | A2 | 3/1982 |
| EP | 0 562 402 | A1 | 9/1993 |
| EP | 0 665 347 | A1 | 8/1995 |
| EP | 0 698 126 | A1 | 2/1996 |
| EP | 0 890 373 | A1 | 1/1999 |
| EP | 0 903 451 | A2 | 3/1999 |
| EP | 0 903 451 | A3 | 8/1999 |
| EP | 1 024 234 | A2 | 8/2000 |
| EP | 1 036 341 | A | 9/2000 |
| EP | 0 843 763 61 | | 10/2000 |
| EP | 1 045 083 | A1 | 10/2000 |
| EP | 1 061 201 | A2 | 12/2000 |
| EP | 1 165 906 | | 1/2002 |
| EP | 1 165 906 | B1 | 8/2002 |
| EP | 1 045 083 | B1 | 10/2002 |
| EP | 1 262 607 | A1 | 12/2002 |
| EP | 1 262 609 | A1 | 12/2002 |
| EP | 1 350 904 | A2 | 10/2003 |
| EP | 1 350 904 | A3 | 10/2003 |
| EP | 1 357 239 | A2 | 10/2003 |

(56) References Cited

FOREIGN PATENT DOCUMENTS

| | | | |
|---|---|---|---|
| EP | 1 362 947 | A2 | 11/2003 |
| EP | 0 890 373 | B1 | 2/2004 |
| EP | 1 357 239 | A3 | 7/2004 |
| EP | 1 437 457 | A2 | 7/2004 |
| EP | 1 036 341 | B1 | 2/2005 |
| EP | 1 640 530 | A2 | 3/2006 |
| EP | 1 938 963 | A1 | 7/2008 |
| EP | 2 189 591 | A2 | 5/2010 |
| EP | 2 189 591 | A3 | 3/2012 |
| FR | 1 293 043 | A | 5/1962 |
| FR | 2 278 876 | A1 | 2/1976 |
| FR | 2 445 875 | A1 | 8/1980 |
| FR | 2 498 666 | A1 | 7/1982 |
| FR | 2 557 905 | | 7/1985 |
| FR | 2 810 060 | A1 | 12/2001 |
| GB | 25 180 | | 0/1907 |
| GB | 484 750 | | 5/1938 |
| GB | 875 327 | | 8/1961 |
| GB | 900 958 | | 7/1962 |
| GB | 1 189 485 | | 4/1970 |
| GB | 1 308 011 | | 2/1973 |
| GB | 1 430 423 | | 3/1976 |
| GB | 1 430 423 | A | 3/1976 |
| GB | 1 520 964 | A | 8/1978 |
| GB | 2 020 998 | A | 11/1979 |
| GB | 2 095 814 | A | 10/1982 |
| GB | 2 117 813 | A | 10/1983 |
| GB | 2 145 371 | A | 3/1985 |
| GB | 2 147 856 | A | 5/1985 |
| GB | 2 243 381 | A | 10/1991 |
| GB | 2 256 023 | A | 11/1992 |
| JP | 56-104936 | U | 1/1981 |
| JP | 56-131752 | A | 10/1981 |
| JP | 57-119056 | | 7/1982 |
| JP | 57-157636 | U | 10/1982 |
| JP | 59-185346 | U | 12/1984 |
| JP | 60-255843 | A | 12/1985 |
| JP | 62-127225 | | 6/1987 |
| JP | 1-178659 | A | 7/1989 |
| JP | 1-202403 | A | 8/1989 |
| JP | 1-33702 | Y2 | 10/1989 |
| JP | 3-169967 | | 7/1991 |
| JP | H05-169534 | A | 7/1993 |
| JP | 5-96282 | U | 12/1993 |
| JP | 05-318674 | A | 12/1993 |
| JP | 06-064108 | | 3/1994 |
| JP | 6-39840 | B2 | 5/1994 |
| JP | 06-315944 | | 11/1994 |
| JP | 7-26467 | U | 5/1995 |
| JP | 7-180333 | A | 7/1995 |
| JP | 8-086080 | A | 4/1996 |
| JP | 8-109734 | A | 4/1996 |
| JP | 9-053319 | A | 2/1997 |
| JP | 09-254697 | | 9/1997 |
| JP | 10-002096 | | 1/1998 |
| JP | 10-219975 | A | 8/1998 |
| JP | 11-131771 | A | 5/1999 |
| JP | 11-268010 | A | 10/1999 |
| JP | 2002-011708 | A | 1/2002 |
| JP | 3363976 | | 1/2003 |
| KR | 1996-0005785 | | 7/1996 |
| KR | 2007/0000322 | A | 1/2007 |
| SE | 506 254 | C2 | 11/1997 |
| SE | 0000785 | A | 9/2001 |
| SE | 0103130 | A | 3/2003 |
| WO | 28 24 656 | A1 | 1/1979 |
| WO | WO 89/03753 | A1 | 5/1989 |
| WO | WO 90/06232 | A1 | 6/1990 |
| WO | WO 94/01628 | A2 | 1/1994 |
| WO | WO 94/26999 | A1 | 11/1994 |
| WO | WO 94/28183 | | 12/1994 |
| WO | WO 95/11333 | | 4/1995 |
| WO | WO 96/07801 | A1 | 3/1996 |
| WO | WO 96/09262 | A1 | 3/1996 |
| WO | WO 96/27721 | A1 | 9/1996 |
| WO | WO 97/10396 | | 3/1997 |
| WO | WO 97/18949 | A1 | 5/1997 |
| WO | WO 97/21011 | | 6/1997 |
| WO | WO 97/47834 | A1 | 12/1997 |
| WO | 0 843 763 | A1 | 5/1998 |
| WO | WO 98/38401 | A1 | 9/1998 |
| WO | WO 98/58142 | A1 | 12/1998 |
| WO | WO 99/17930 | A1 | 4/1999 |
| WO | WO 99/58254 | A1 | 11/1999 |
| WO | WO 99/66151 | A1 | 12/1999 |
| WO | WO 99/66152 | A1 | 12/1999 |
| WO | WO 00/17467 | A1 | 3/2000 |
| WO | WO 00/22225 | A1 | 4/2000 |
| WO | WO 00/44984 | A1 | 8/2000 |
| WO | WO 00/47841 | A1 | 8/2000 |
| WO | WO 00/66856 | A1 | 11/2000 |
| WO | WO 01/02669 | A1 | 1/2001 |
| WO | WO 01/02671 | A1 | 1/2001 |
| WO | WO 0102670 | A1 * | 1/2001 |
| WO | WO 01/47726 | A1 | 7/2001 |
| WO | WO 01/48331 | A1 | 7/2001 |
| WO | WO 01/48332 | A1 | 7/2001 |
| WO | WO 01/48333 | A1 | 7/2001 |
| WO | WO 01/51732 | A1 | 7/2001 |
| WO | WO 01/51733 | A1 | 7/2001 |
| WO | WO 01/53628 | A1 | 7/2001 |
| WO | WO 01/66877 | A1 | 9/2001 |
| WO | WO 01/75247 | A1 | 10/2001 |
| WO | WO 01/77461 | A1 | 10/2001 |
| WO | WO 01/88306 | A1 | 11/2001 |
| WO | WO 01/02669 | A1 | 1/2002 |
| WO | WO 02/055809 | A1 | 7/2002 |
| WO | WO 02/055810 | A1 | 7/2002 |
| WO | WO 02/060691 | A1 | 8/2002 |
| WO | WO 02/092342 | A1 | 11/2002 |
| WO | WO 03/012224 | A1 | 2/2003 |
| WO | WO 03/025307 | A1 | 3/2003 |
| WO | WO 03/035396 | A1 | 5/2003 |
| WO | WO 03/038210 | A1 | 5/2003 |
| WO | WO 03/078761 | A1 | 9/2003 |
| WO | WO 03/083234 | A1 | 10/2003 |
| WO | WO 03/089736 | A1 | 10/2003 |
| WO | WO 2004/005648 | A1 | 1/2004 |
| WO | WO 2004/053257 | A1 | 6/2004 |
| WO | WO 2004/085765 | A1 | 10/2004 |
| WO | WO 2004/052357 | A8 | 11/2004 |
| WO | WO 2004/053257 | A8 | 12/2004 |
| WO | WO 2005/068747 | A1 | 7/2005 |
| WO | WO 2006/043893 | A1 | 4/2006 |
| WO | WO 2006/133690 | A1 | 12/2006 |
| WO | WO 2007/015669 | A2 | 2/2007 |
| WO | WO 2007/015669 | A3 | 2/2007 |
| WO | WO 2007/020088 | A1 | 2/2007 |
| WO | WO 2007/081267 | A1 | 7/2007 |
| WO | WO 2008/004960 | A2 | 1/2008 |
| WO | WO 2008/004960 | A3 | 1/2008 |
| WO | WO 2008/004960 | A8 | 1/2008 |
| WO | WO 2008/008824 | A1 | 1/2008 |
| WO | WO 2008/133377 | A1 | 11/2008 |
| WO | WO 2008/142538 | A2 | 11/2008 |
| WO | WO 2009/061279 | A1 | 5/2009 |
| WO | WO 2009/116926 | A1 | 9/2009 |
| WO | WO 2010/015516 | A2 | 2/2010 |
| WO | WO 2010/015516 | A3 | 2/2010 |
| WO | WO 2010/023042 | A1 | 3/2010 |
| WO | WO 2010/028901 | A1 | 3/2010 |
| WO | WO 2010/081532 | A1 | 7/2010 |
| WO | WO 2010/087752 | A1 | 8/2010 |
| WO | WO 2011/012104 | A2 | 2/2011 |
| WO | WO 2011/012104 | A3 | 2/2011 |
| WO | WO 2011/028171 | A1 | 3/2011 |
| WO | WO 2011/077311 | A2 | 6/2011 |

OTHER PUBLICATIONS

U.S. Appl. No. 14/324,677, Pervan.

International Search Report issued in PCT/SE2010/050941, Nov. 1, 2010, Patent-och registreringsverket, Stockholm, SE, 5 pages.

Boo, Christian, U.S. Appl. No. 14/224,628 entitled "Floorboards

(56) References Cited

OTHER PUBLICATIONS

Provided With a Mechanical Locking System", filed in the U.S. Patent and Trademark Office Mar. 25, 2014.
Pervan, Darko, et al., U.S. Appl. No. 14/324,677 entitled "Floorboard and Method for Manufacturing Thereof," filed in the U.S. Patent and Trademark Office Jul. 7, 2014.
Chen, Hao, et al., U.S. Appl. No. 14/693,232 entitled "Thermoplastic Planks and Methods for Making the Same," filed in the U.S. Patent and Trademark Office Apr. 22, 2015.
U.S. Appl. No. 14/790,774, Lundblad et al.
U.S. Appl. No. 14/790,850, Lundblad et al.
Välinge Innovation AB, Technical Disclosure entitled "Mechanical locking for floor panels with Vertical Folding," IP.com No. IPCOM000179246D, Feb. 10, 2009, IP.com PriorArtDatabase, 59 pp.
Composite Panel Report: *Laminate Flooring, Wood Digest,* Sep. 1999, p. 37, Cygnus Publishing, Inc., & Affiliates, Fort Atkinson, WI, 6 pages.
European Search Report in EP 1 108 529, Apr. 17, 2002 (Mar. 6, 2002), The Hague, NL, 3 pages.
Official Communication form European Patent Office for EP 00 127 179.0 dated Mar. 21, 2007, 4 pages.
Wilkes, et al.., "Table 5.3 Typical properties of General Purpose Vinyl Plastic Products," PVC Handbook, ISBN 3-446-22714-8, 1988, p. 184.
"Plasticizer," dated Feb. 29, 2012, from Wikipedia (6 pages).
"Polyvinyl chloride," dated Feb. 29, 2012, from Wikipedia (13 pages).
"Reference: Polymer Properties," Polymer Products from Aldrich, dated 1993, (2 pages).
PVC Resin-Solution Viscosity-K Value Chart, Plastemart, (1 page).
Notice of Opposition to a European Patent dated Feb. 29, 2012, filed with the European Patent Office in related European Patent No. 1108529 (EP Patent Application No. 00127179.0) (23 pages).
Notice of Opposition to a European Patent dated Nov. 6, 2013, filed with the European Patent Office in related European Patent No. 2248665 (EP Patent Application No. 10007691.8) (22 pages).
Communication from European Patent Office dated Oct. 29, 2013 with Letter from Opponent dated Oct. 24, 2013 in related European Patent No. 1108529 (EP Patent Application No. 00127179.0) (11 pages).
Laminatfußböden, Technik und Technologien, Laminatforum, 1999, pp. 23-24.
Mobil oil/Holzwerkstoff-Symposium, Stuttgart 1998, Volker Kettler, Witex AG, pp. 1-24.
Ullmann's Encyclopedia of Industrial Chemistry, 1996, vol. A28, pp. 345-350.
Holzwerkstoffe, Herstellung und Verarbeitung; Platten, Beschichtungsstoffe, Formteile, Türen, Möbel; Von Hansgert Soiné; DRW-Verlag, 1995 (51 pages).
Excerpt from Bodenwanddecke, "USA: Das sind die Trends," Apr. 2000, p. 7.
Summons to attend oral proceedings pursuant to Rule 115(1) EPC from European Patent Office dated Nov. 5, 2013 in related European patent No. 1108529 (EP Patent Application No. 00127179.0 (13 pages).
Lundblad, Christer, et al., U.S. Appl. No. 14/790,774 entitled "Method to Produce a Thermoplastic Wear Resistant Foil," filed in the U.S. Patent and Trademark Office Jul. 2, 2015.
Lundblad, Christer, et al., U.S. Appl. No. 14/790,850 entitled "Method to Produce a Thermoplastic Wear Resistant Foil," filed in the U.S. Patent and Trademark Office Jul. 2, 2015.
U.S. Appl. No. 14/932,126, Chen, et al.
U.S. Appl. No. 14/946,080, Bergelin et al.
Chen, Hao A, et al., U.S. Appl. No. 14/932,126 entitled "Thermoplastic Planks and Methods for Making the same," filed in the U.S. Patent and Trademark Office on Nov. 4, 2015.
Bergelin, Marcus, et al., U.S. Appl. No. 14/946,080, entitled "Resilient Groove," filed in the U.S. Patent and Trademark Office Nov. 19, 2015.

* cited by examiner

RESILIENT FLOOR

CROSS-REFERENCE TO RELATED APPLICATIONS

This application is a continuation of U.S. application Ser. No. 13/734,406, filed on Jan. 4, 2013, which is a continuation of U.S. application Ser. No. 12/875,293, filed on Sep. 3, 2010, now U.S. Pat. No. 8,365,499, which claims benefit to U.S. Provisional Application No. 61/239,927, filed Sep. 4, 2009. U.S. application Ser. No. 13/734,406, U.S. application Ser. No. 12/875,293 and U.S. Provisional Application No. 61/239,927 are each hereby incorporated by reference in its entirety.

TECHNICAL FIELD

The present invention generally concerns a method of assembling of floorboards provided with a mechanical locking system.

BACKGROUND OF THE INVENTION

Floorboards with a wood based core that are provided with a mechanical locking system and methods of assembling such floorboards by angling-angling, angling-snapping or vertical folding are disclosed in e.g. WO 94/26999, WO 01/77461, WO 2006/043893 and WO 01/75247. Floorboards of resilient material, e.g. PVC, are known, commonly referred to as LVT (Luxury Vinyl Tiles) that are glued down to the subfloor or bonded at the edges to each other WO 2008/008824.

SUMMARY OF THE INVENTION

A method is disclosed for assembling of floorboards, which are so called resilient floorboards i.e. the core is of a resilient material for example vinyl or PVC. The known methods of assembling floorboards that are mentioned above are difficult to use when assembling resilient floorboards since resilient floorboards easily bend which make it hard to use the angling-angling method and it is unfeasible to use the angling-snapping method since it requires a force to be applied, at an opposite edge in relation to the edge of the floorboard which is intended to be connected, by e.g. a hammer and a tapping block and the resilient core of the resilient floorboard absorbs the applied force. The known vertical folding methods are also difficult to apply due to the increased friction in the resilient material. The disclosed method makes the assembling easier and reduces the force needed for connection of the floorboards.

Furthermore, a locking system suitable for the method is disclosed. The locking system decreases the friction forces that must be overcome when installing the resilient floorboards.

An aspect of the invention is a method of assembling resilient floorboards, which are provided with a mechanical locking system, which method comprises the step of:

- positioning a floorboard edge, provided with a first device of said mechanical locking system (11), juxtaposed another floorboard edge, provided with a second device of said mechanical locking system (11);
- bending (30) the floorboard (2) along the edge; and
- applying a force (F) on a first part of the floorboard edge, wherein at said first part of the floorboard edge said first device is pushed into said second device to obtain a vertical and horizontal mechanical locking of a part of the floorboards' edges.

The bending makes it possible to finalize the connection of only a part of the edge of the floorboard, instead of the whole edge as in the known methods, and consequently the force needed to assemble the floorboards is considerably reduced.

The bending is preferably achieved by raising an outer part of said edge preferably by positioning of a raising device, e.g. a wedge, or a hand/finger of the assembler under said floorboard. The raised position of the outer part of said edge is preferably maintained during the force-applying step. In a preferred embodiment also the position of the raising device is maintained during the force-applying step.

The method comprises thereafter preferably the step of applying a force to a new part of the edge, which new part is adjacent to the mechanically locked part, and repeating this step until the whole edge is connected to said another edge.

The force is preferably applied by a tool and most preferably by a tool with a rotatable part.

In a preferred embodiment, the first device is an upper locking strip, which is resiliently bendable, with a downwardly protruding locking element and the second device is a lower locking strip provided with an upwardly protruding locking element. The resiliently bendable locking strip facilitates the connection of the floorboards. The downwardly protruding locking element is provided with a locking surface, which cooperates, for horizontal locking, with a locking surface of the upwardly protruding locking element. The locking strips are integrally formed with the resilient floorboards and preferably of the same resilient material. The downwardly and/or the upwardly protruding locking element is preferably provided with a guiding surface which are configured to guide the locking elements in to a position where the floorboards are connected by the locking elements and the locking surfaces cooperate.

The resilient floorboards are in a preferred embodiment made of a bendable thermo plastic, e.g. vinyl, surlyn, and PVC. Floorboards of vinyl are generally referred to as LVT (Luxury Vinyl Tiles). In a most preferred embodiment the thickness of the floorboard is about 4 mm to about 10 mm. If the floorboards are too thin it is hard to produce a locking system integrally in the floorboard material and if they are too thick it is hard to assemble the floorboards with the disclosed method.

The floorboards are in a preferred embodiment provided with an upper decorative layer made of a similar resilient material and most preferably provided with a balancing layer and/or a sublayer.

The force is preferably applied with a tool, which comprises a handle and a press part for applying a force on the floorboard. Preferably, the press part is provided with an outer round or circular shape for applying the force on the floorboard and in the most preferred embodiment the press part is rotatable.

DETAILED DESCRIPTION OF EMBODIMENTS

Figure 1A:
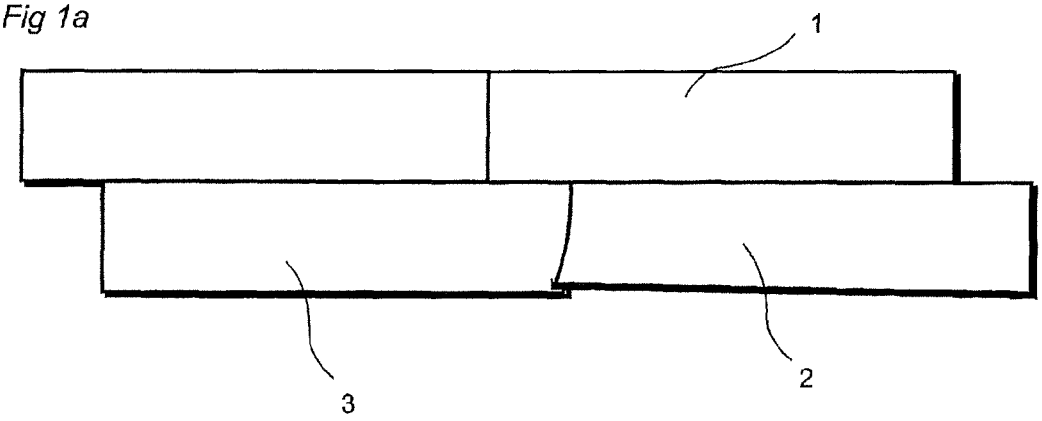
FIGS. 1*a*-*b* show an embodiment of the assembling method.
Figure 1B:
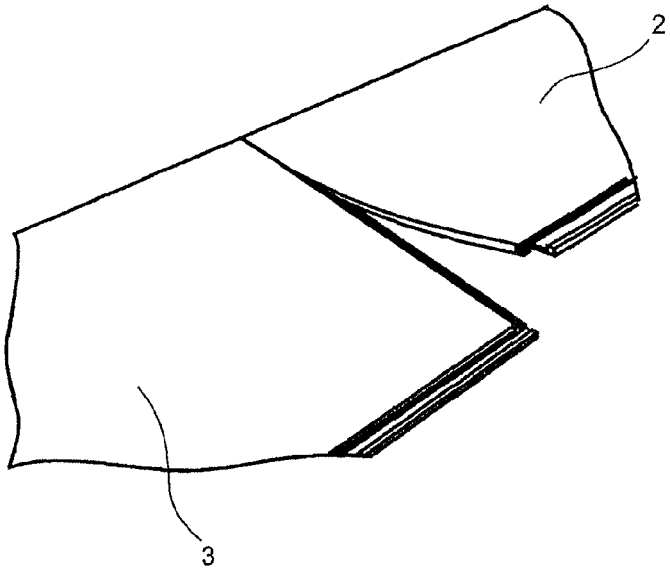

An embodiment of a method of assembling resilient floorboards (1, 2, 3) with a mechanical locking system 11 is shown in FIGS. 1*a* and 1*b*. An edge of a floorboard 2 is positioned juxtaposed another edge of another floorboard 3. The edge of the floorboard is bent (30) along the edge during the assembling and the connection of the floorboard edges to each other. In this embodiment the edge and said another edge are short edges and a long edge of the floorboard is connected to a long edge of a floorboard 1 in another row, by a mechanical angling locking system, simultaneous with the short edge connection, by an angular motion.

Figure 5A:
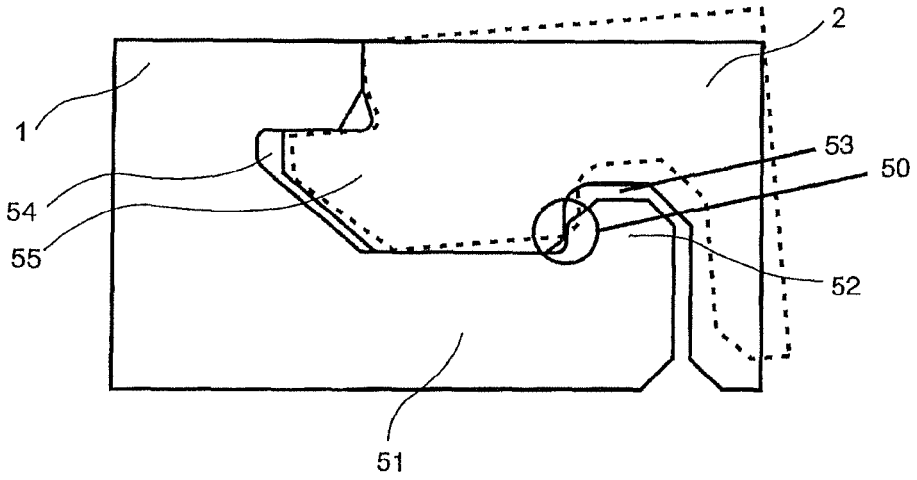
FIGS. 5*a*-5*b* show an embodiment of a locking system configured for connection by angling.
Figure 5B:
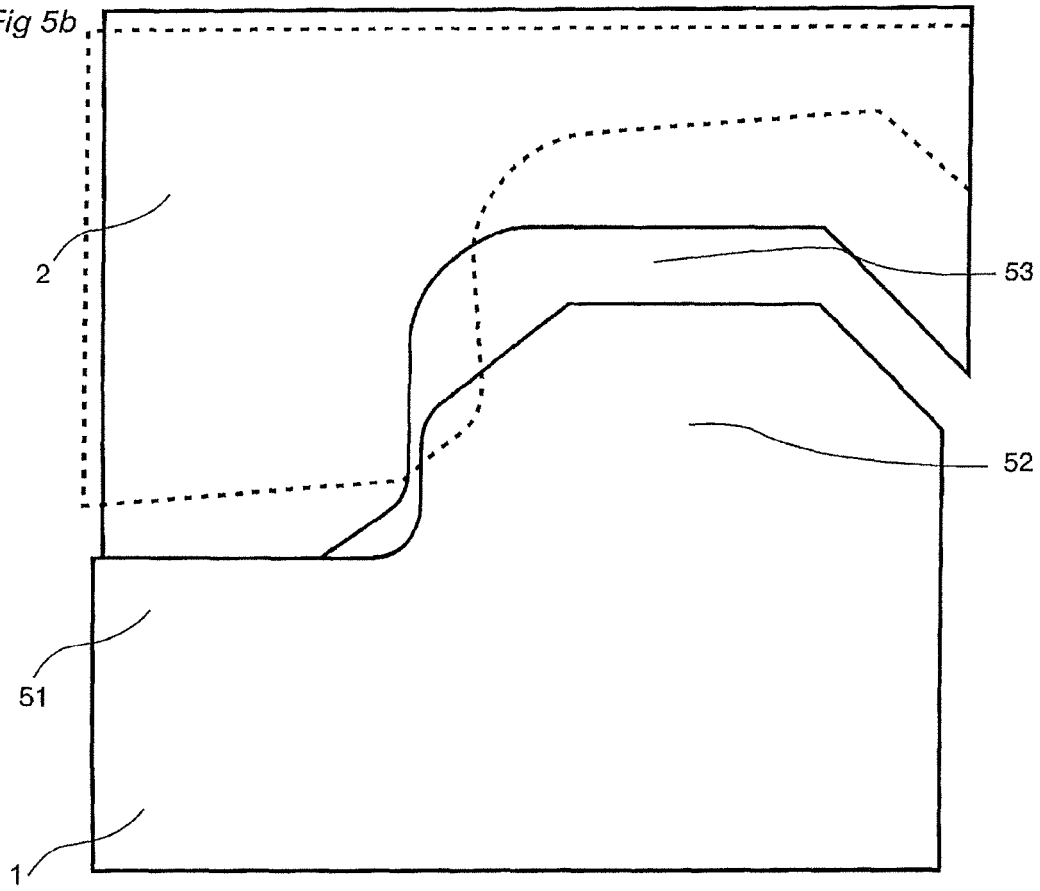

An embodiment of a mechanical angling locking system is shown in FIGS. 5*a* and 5*b*. Embodiments of the mechanical locking system 11 at the short edges is shown in FIGS. 6*a* to 9*a*. When assembling a complete floor the method shown in FIG. 1*a* is naturally applied and repeated for each resilient floorboard, which is provided with the locking system at each short edge and the mechanical angling locking system at each long side, until all resilient floorboards are connected.

The resilient floorboards may also be of square shape with the mechanical locking system 11 provided at two opposite edges of each floorboard and the mechanical angling locking system provided at two other opposite edges of each floorboard. It is also possible to provide floorboards of rectangular shape with the mechanical locking system 11 at the long edges and the mechanical angling locking system at the short edges.

Figure 2A:
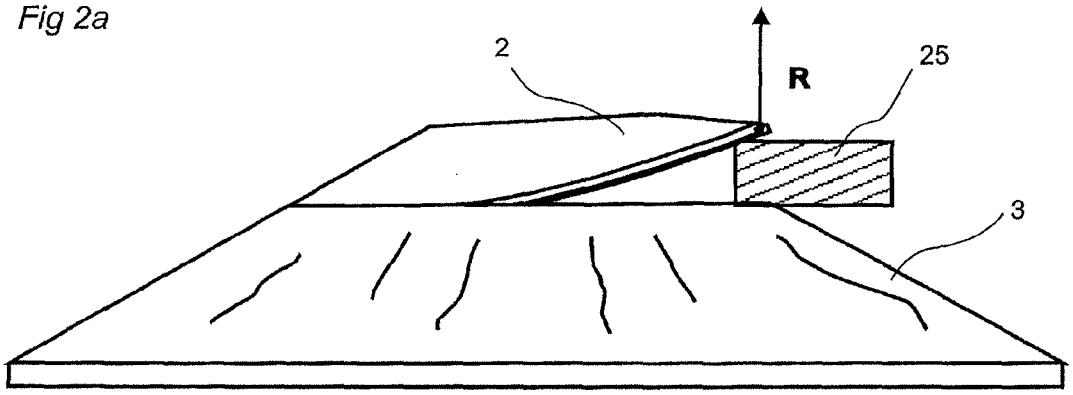
FIGS. 2*a*-2*b* show an embodiment of the assembling method.
Figure 2B:
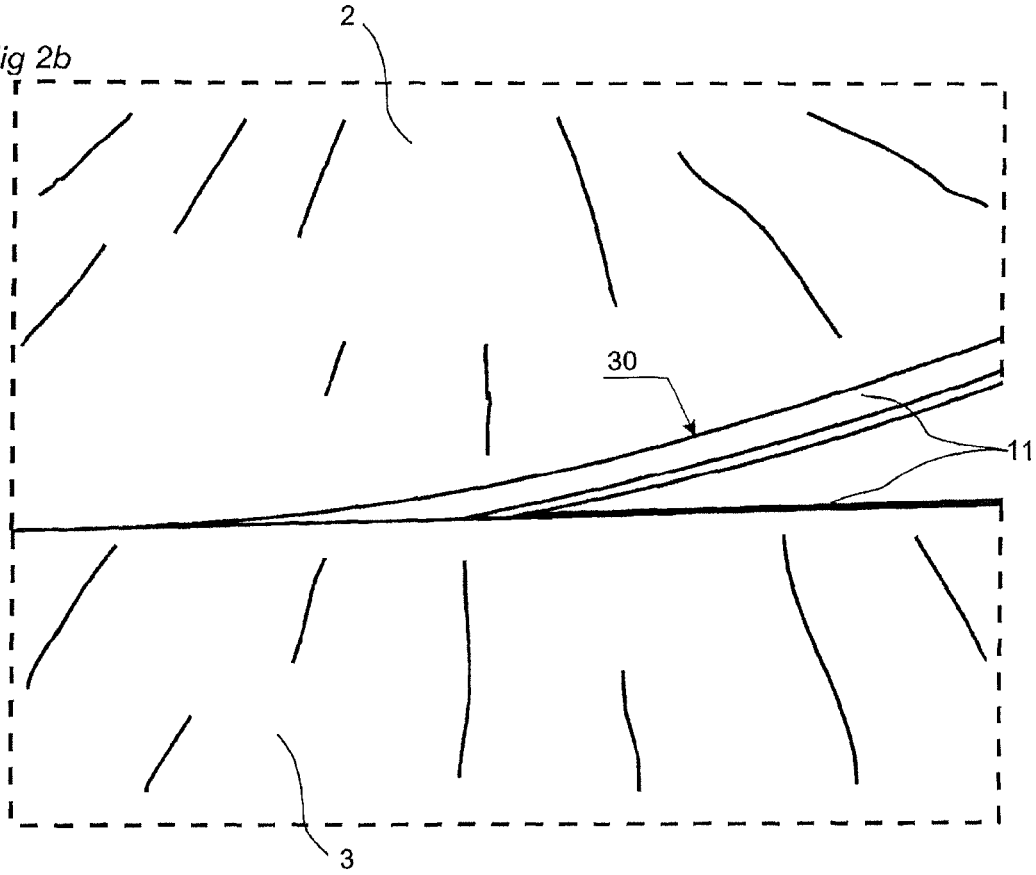
Figure 3A:
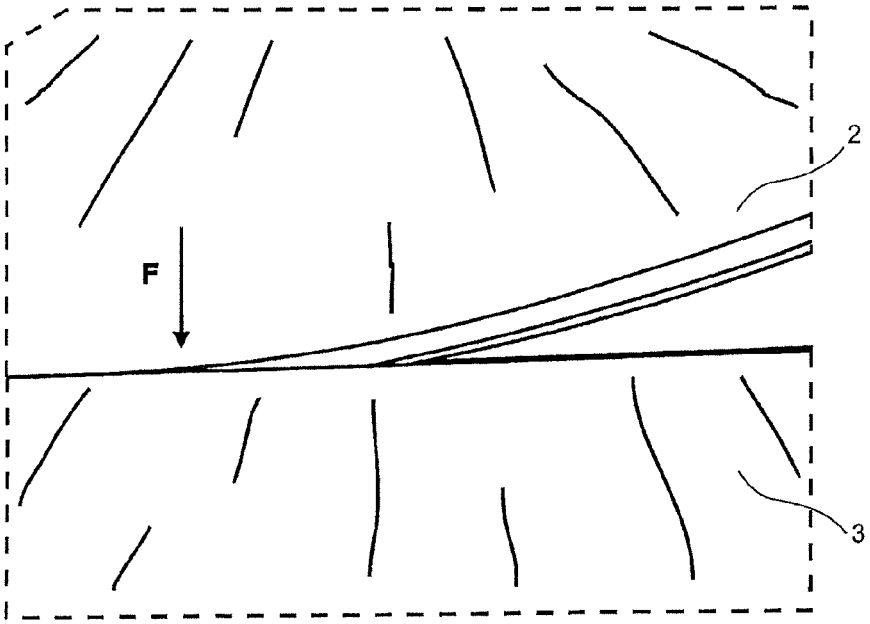
FIGS. 3*a*-3*b* show embodiments of the assembling method.

FIG. 2*a* shows the assembling from another view and FIG. 2*b* shows a detailed view of the bent (30) floorboard 2 edge and that a part of the edge is pressed down such that parts of the floorboards 2,3 are locked to each other by the mechanical locking system 11. The edge is pressed down by applying a vertical force F at the edge on the floorboard, as disclosed in FIG. 3*a*, on a part of the edge which is closest to said another edge, wherein the part of the edge is mechanically locked to another part of said another edge by the mechanically locking system 11. This is repeated until the whole edge is connected vertically and horizontally to said another edge.

The bending of the floorboard makes it possible to finalize the locking of only a part of the edge of the floorboard, instead of the whole edge as in the known methods, and as a result the force required to connect the floorboards is considerably reduced. Since only a part of the edge of the floorboard is locked the area in the mechanical locking system that is in contact during the connection is reduced and consequently the friction created in the mechanical locking is reduced and thereby the force required. The bending is preferably achieved by raising (R) an outer part of said edge by positioning of a raising device (25), e.g. a wedge, or a hand/finger of the assembler under said floorboard. The position of the raising device is maintained during the force-applying step.

Figure 3B:
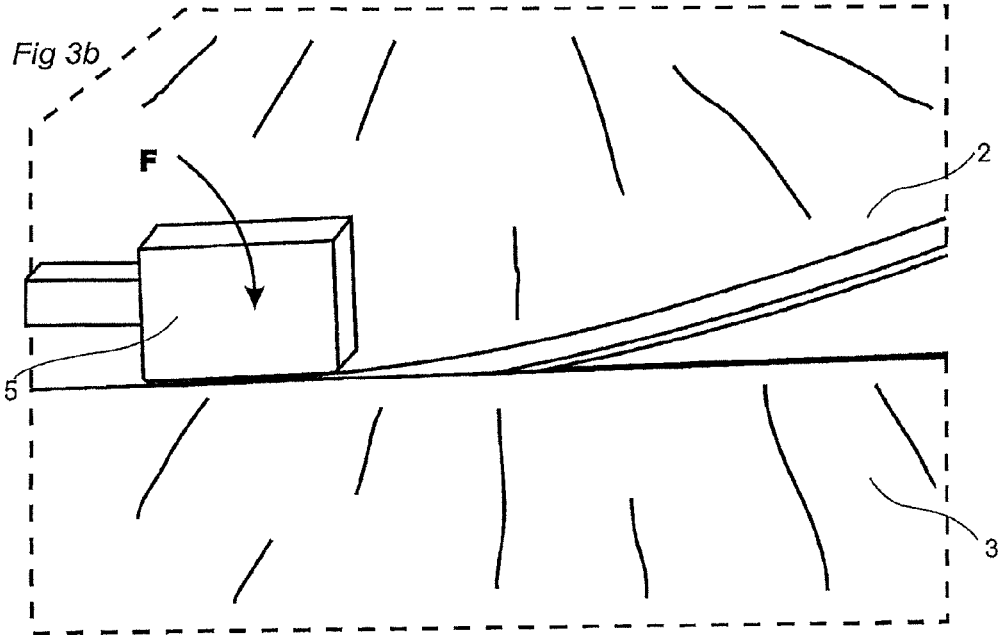
Figure 4A:
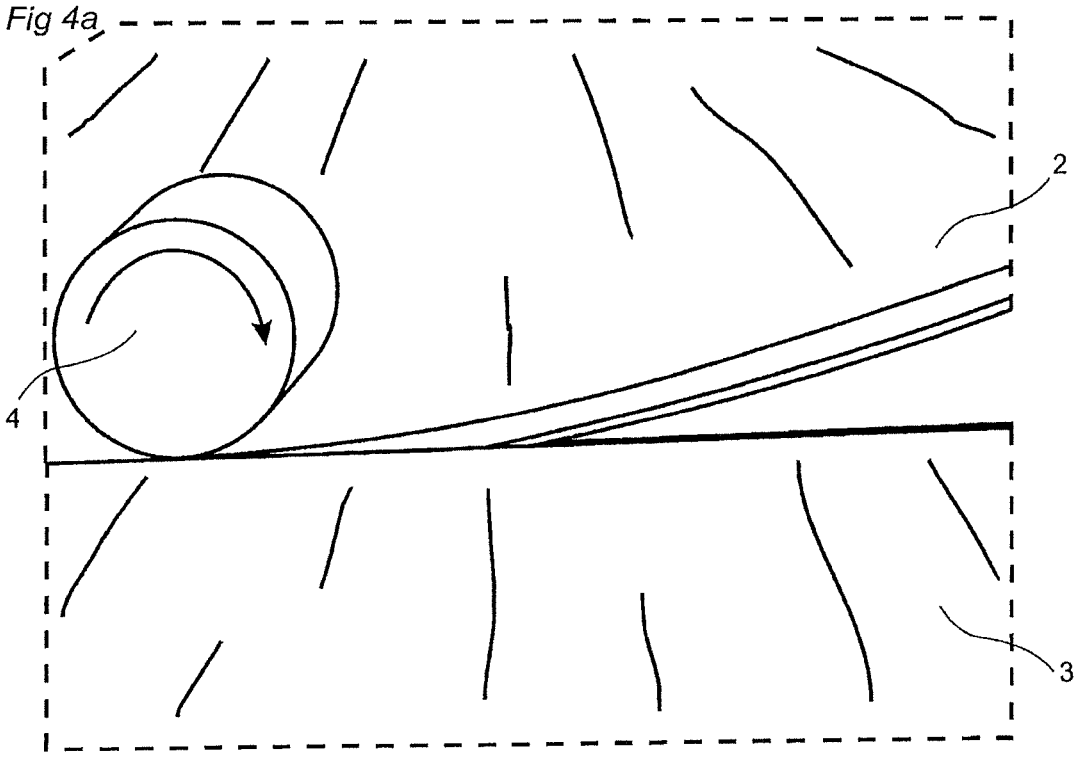
FIGS. 4*a*-4*b* show embodiments of the assembling method.
Figure 4B:
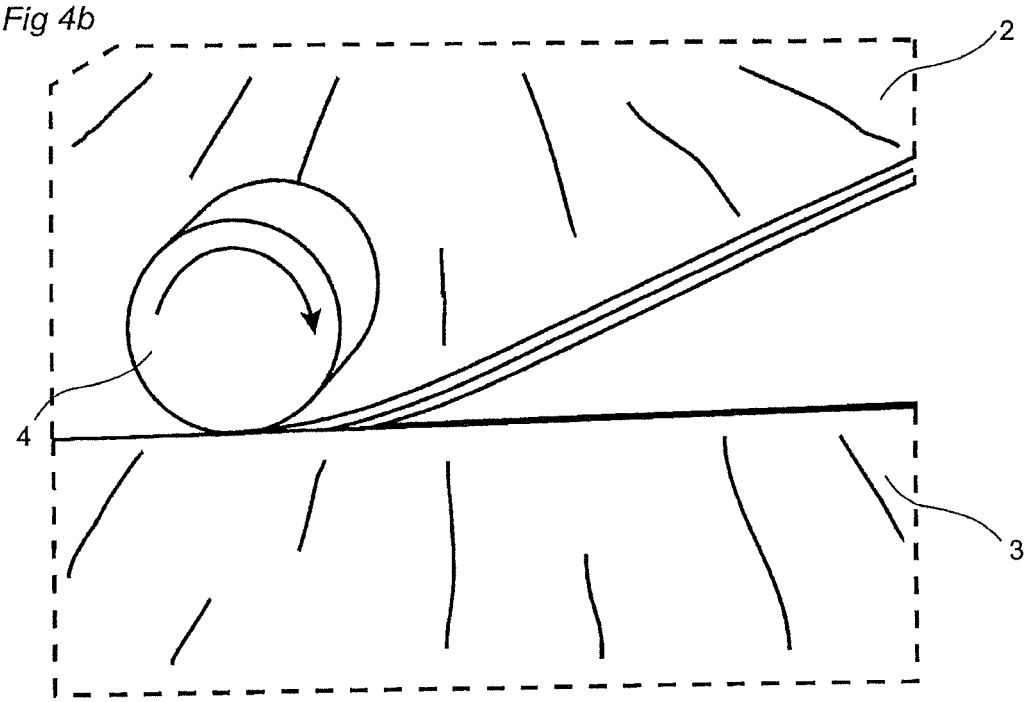

The force may be applied directly, without tools, on the floorboard e.g. by a hand or a foot of the assembler. However, a tool 4,5 may be used to apply the force as disclosed in FIGS. 3*b*, 4*a* and 4*b*. In FIG. 4*b* only a part of the floorboard is bent while the rest of the floorboard edge continues straight in the direction of the tangent of the bent part. Most preferably a tool with a rotatable press part is used to apply the force. FIG. 9*b* shows an embodiment of such a tool.

The floorboard-assembling tool in FIG. 9*b* comprises a handle 93 and press part 94, which is of a circular shape. The rotatable press part 94 makes it easy to move the tool, by one hand of the assembler, along the edge of the floorboard, which is going to be connected, and bend the floorboard with the other hand.

The mechanical angling locking system in FIG. 5*a-b* comprises a locking strip 51, a locking element 52 and a tongue groove 54 at an edge of a resilient floorboard 1 and a locking groove 53 and a tongue 55 at an edge of an adjacent resilient floorboard 2. The tongue 55 cooperates with the tongue groove 54 for vertical locking and the locking element 52 cooperates with the locking groove 53 for horizontal locking, similar to the angling locking systems disclosed in WO 01/77461.

Compared to the locking system, which is produced in a wood based core, disclosed in WO 01/77461 it is possible to produce a mechanical angling locking system in a resilient floorboard with a shorter locking strip and/or higher locking angle and/or increased locking surface area, as disclosed in FIG. 5*b*, which is an enlarged view of area 50 in FIG. 5*a*. This is due to the resilient material, which makes it possible to bend the locking strip more without breaking it. The angling locking system is preferably integrally formed in one piece with the resilient material of the floorboard.

Figure 6A:
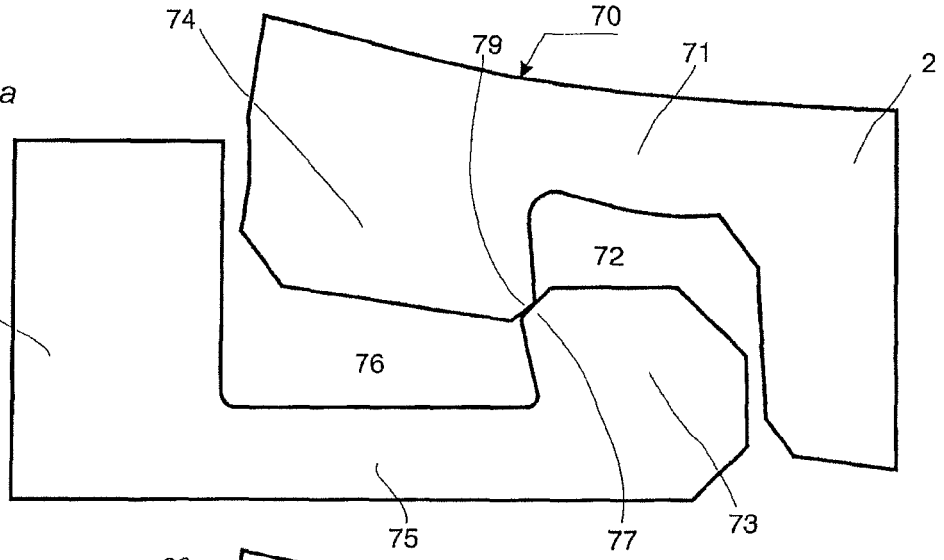
FIGS. 6*a*-6*c* show an embodiment of resilient floorboards during assembling.
Figure 6B:
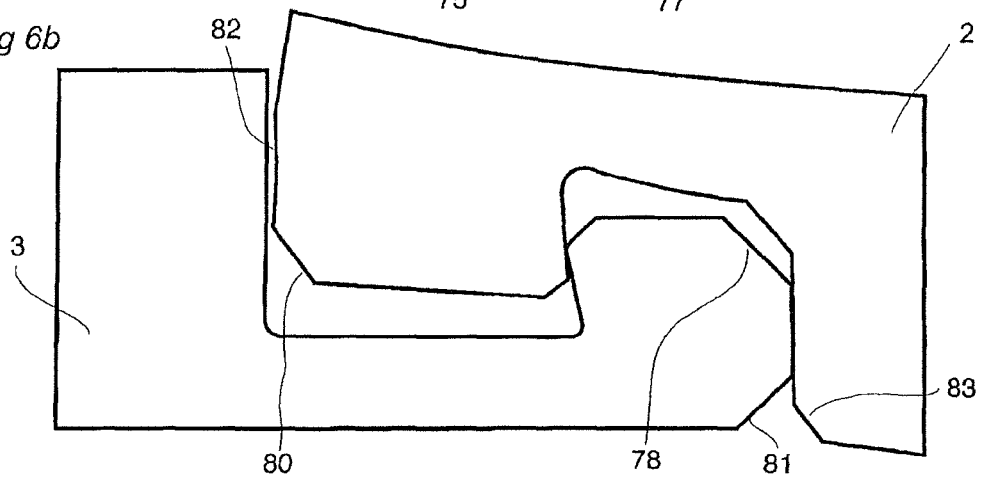
Figure 6C:
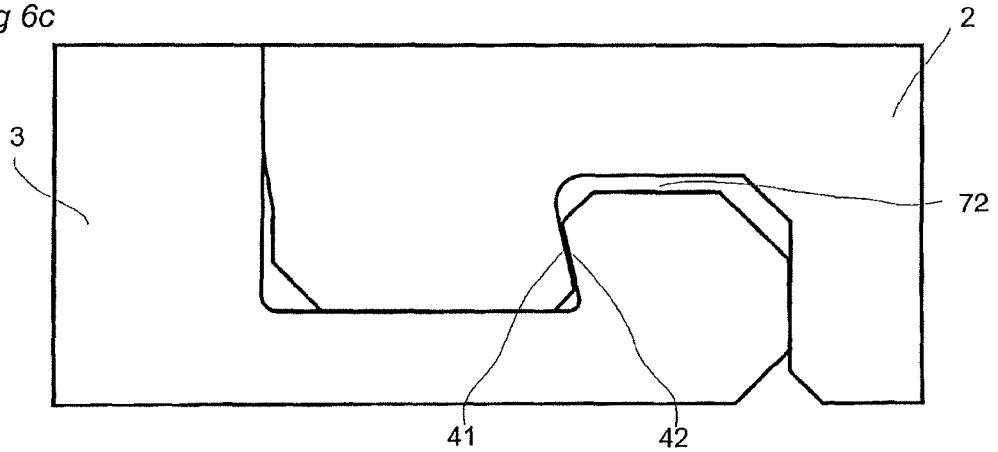

An embodiment of the mechanical locking system is disclosed in FIGS. 6*a*-6*c* in which figures a cross-section of the locking system is shown in three sequential steps during the connection. A first device of the mechanical locking system comprises an upper, and upwardly resiliently bendable, locking strip 71 at an edge of a floorboard 2 and a second device of the mechanical locking system comprises a lower locking strip 75 at an edge of another floorboard 3. The upper and the lower locking strip is provided with a downwardly and an upwardly protruding locking element 74, 73 respectively. The locking elements are provided with locking surfaces 41, 42 configured to cooperate for horizontal locking of the floorboards.

An upwardly bending of the upper locking strip 71 across the edge (see FIG. 6*a*-6*b*), facilitates a positioning of the downwardly protruding locking element 74 between the upwardly protruding locking element and an upper edge of the floorboard 3 in a position where the locking surface cooperates, as shown in FIG. 6*c*.

The downwardly protruding locking element is preferably provided with a guiding surface 79, which is configured to cooperate (see FIG. 6*a*) with the upwardly protruding locking element 73 in order to facilitate the positioning.

Preferably, the upwardly protruding locking element 73 is provided with another guiding surface 77, which is configured to cooperate (see FIG. 6*a*) with the guiding surface 79 to further facilitate the positioning.

It is also possible to only provide the upwardly protruding locking element 73 with a guiding surface, which is configured to cooperate with an edge of the downwardly protruding locking element.

The angle 44 of the guiding surface 79 and the angle of 43 said another guiding surface 77 are preferably more than about 30° and most preferably more than about 45°.

In a preferred embodiment the mechanical locking system is provided with one or more additional guiding surfaces, which guide the floorboards to the correct location for connection:

a guiding surface 80 at the downwardly protruding locking element, which guiding surface cooperates with an upper edge of the said other floorboard; and a guiding surface 83 at the lower edge of the floorboard, which guiding surface cooperates with an edge or a guiding surface of the upwardly protruding locking element.

A space 81, shown in FIG. 6*b*, under the upwardly protruding locking element facilitates bending of the lower locking strip during the connection of the lower locking strip. A space 72 above the upwardly protruding locking element ensures a proper connection of the floorboards, without risking that the floorboard is prevented reaching the position were the upper surfaces of the floorboards are in the same plane.

Figure 7A:
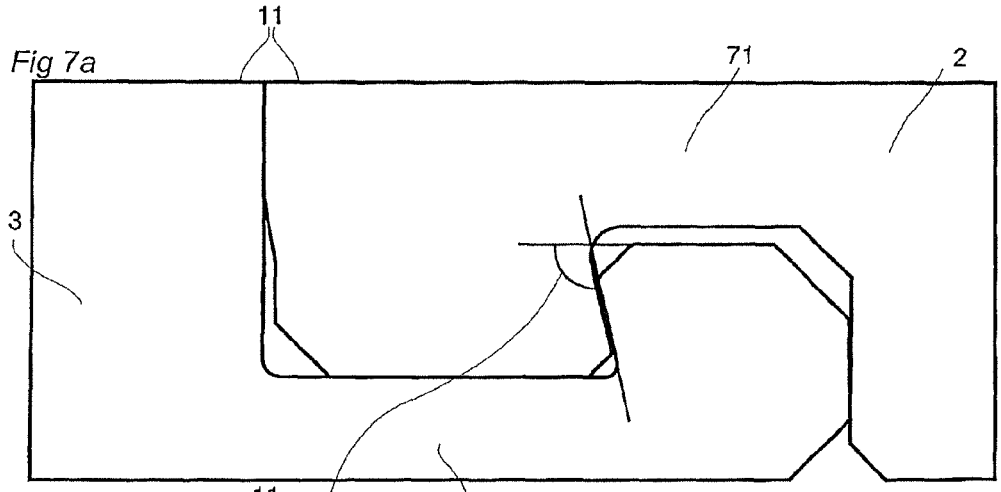
FIGS. 7*a-c* show embodiments of a locking system for resilient floorboards.
Figure 7B:
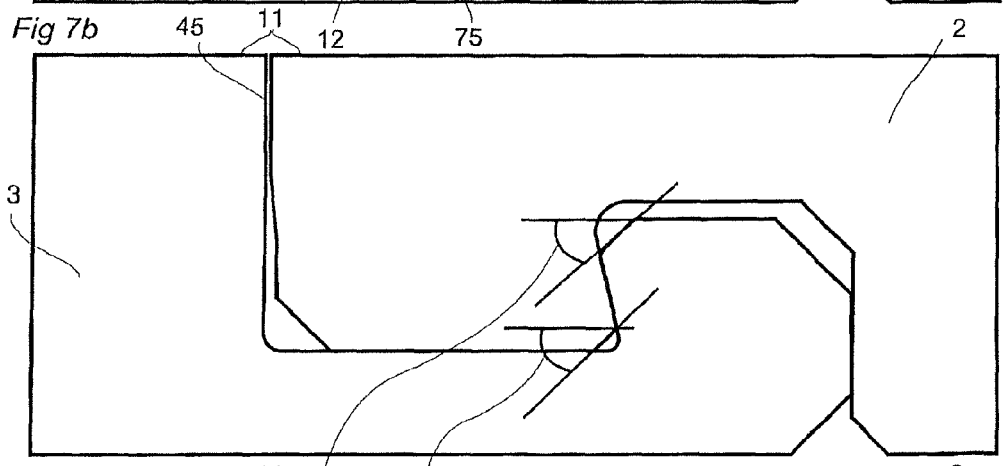
Figure 7C:
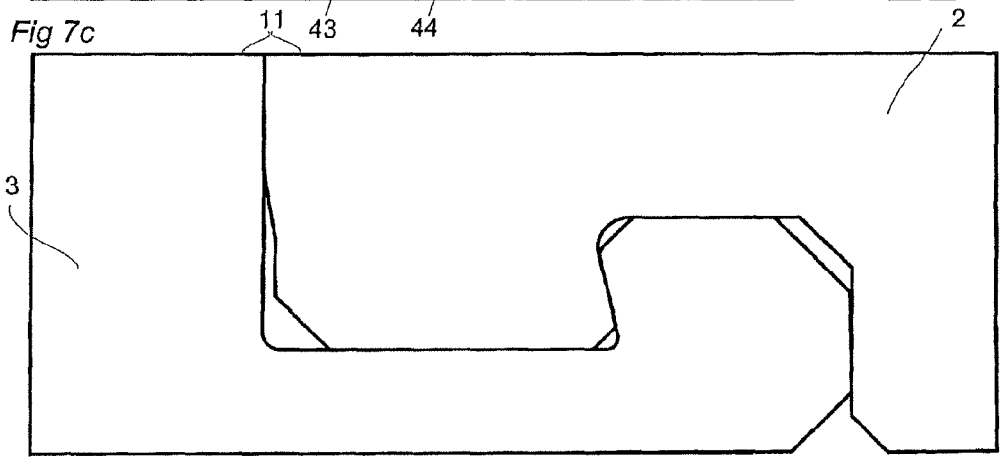
Figure 8A:
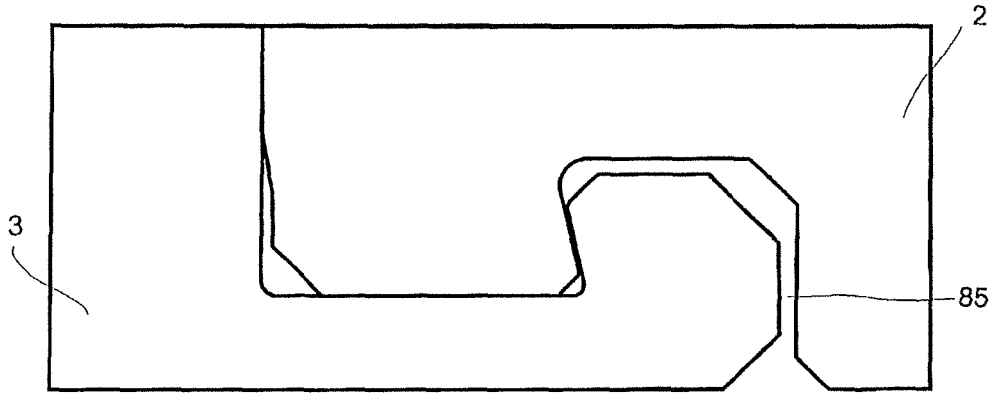
FIGS. 8*a*-8*c* show embodiments of a locking system for resilient floorboards
Figure 8B:
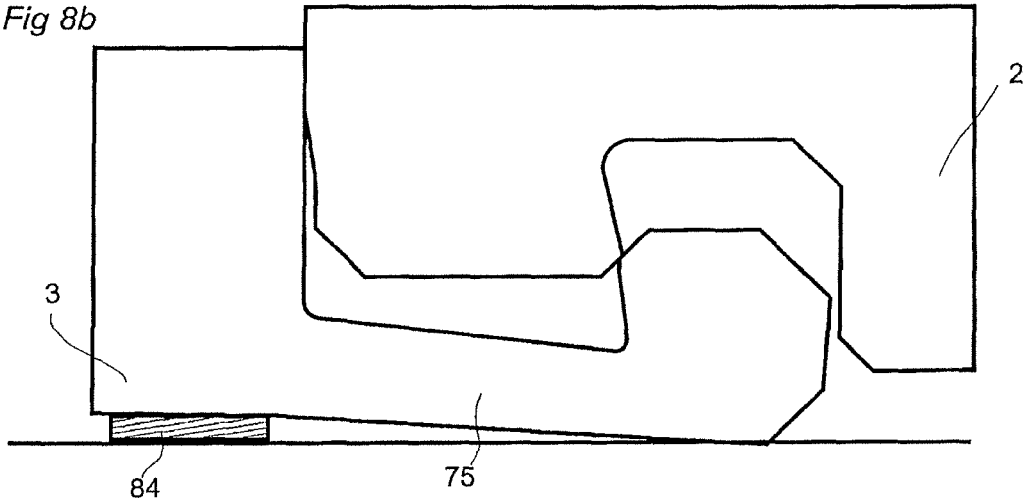
Figure 8C:
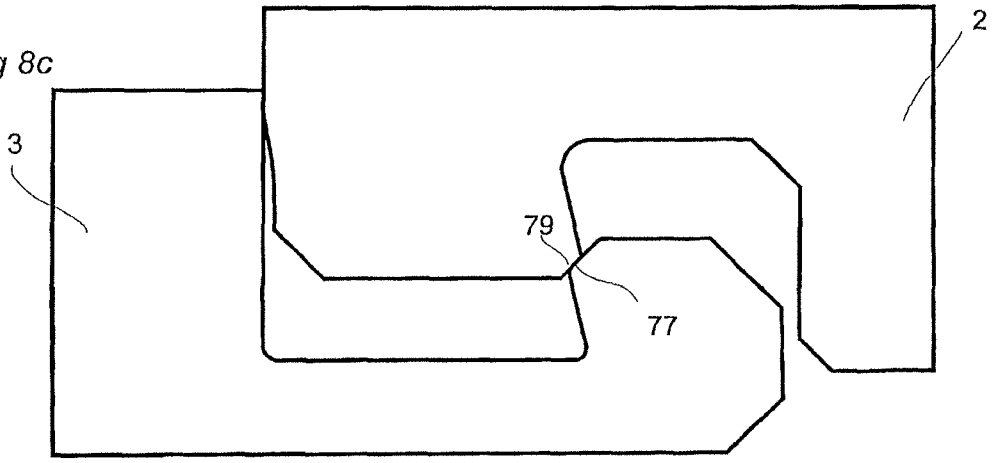

The number and area of the contact and locking surfaces should generally be minimized to ease connection of the floorboards. A small play 45 between the top edges of the floorboards (see FIG. 7*b*, 45) makes them easier to install, but a tight (see. FIG. 7*a*) fit increases the vertical locking strength. To achieve a connection which is more resistant to moisture it is possible to have contact surfaces and a tight fit between the between the lower edges of the floorboards, which also increases the vertical and horizontal locking strength. However, the tight fit also makes it harder to connect the floorboards and a space (see FIG. 8*a-c*, 85) makes it easier. An even more moisture resistant connection is achieved if the space 72 above the upwardly protruding locking element is eliminated (see FIG. 7*c*).

The angle 12 between the locking surfaces and the upper surface of the floorboards are preferably more than 90° to obtain a vertical locking in the position where the locking surface cooperates.

The locking strips 71, 75 are integrally formed in the floorboard, and preferably the whole locking system is integrally formed in one piece with the resilient material of the floorboard. However, it is possible to add separate pieces to increase the locking strength, e.g. in the form of a tongue of stiffer material, of e.g. plastic or metal of e.g. aluminum, preferably for the vertical locking.

A downwardly bending across edge of the lower locking strip 75 (see FIG. 8*b*) further facilitates the positioning of the locking elements in the position where the locking surface cooperates. Bending of the lower strip is preferably achieved by positioning of a spacer 84 between the floorboard edge and the subfloor, and inside the lower locking strip such that the lower locking strip can bend freely. It is also possible to produce a lower locking strip whose lower part is removed to create a free space between the subfloor and lower the locking strip. However, that also reduces the bending strength of the locking strip, which is not desirable since a locking strip of resilient material, e.g. vinyl, has a relatively weak resilient strength. A reduced bending strength of the locking strip means a reduced locking strength of the locking system.

Figure 9A:
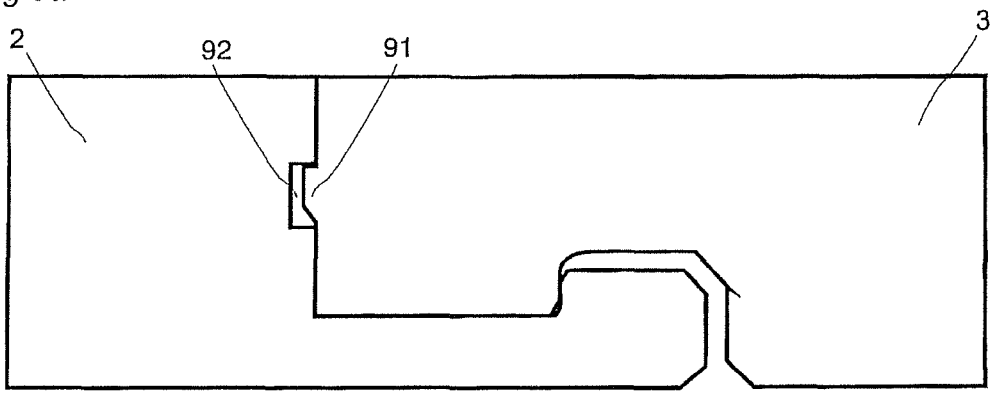
FIGS. 9*a-b* show an embodiment of a locking system and an embodiment of the assembling tool.
Figure 9B:
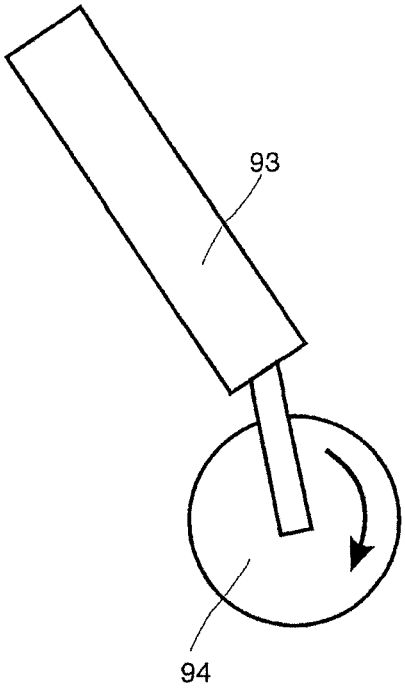

FIG. 9*a* shows an embodiment comprising a tongue 91 at the edge of a floorboard, cooperating with a tongue groove 92 at the edge of an adjacent floorboard, cooperating for vertical locking of the floorboards. The embodiment in FIG. 9*a* is provided with the tongue at the edge of the floorboard with the upper locking strip and the tongue groove at the edge of the floorboard with the lower locking strip. However it is also possible to provide the tongue at the edge of the floorboard with the lower locking strip and the tongue groove at the edge of the floorboard with the upper locking strip. These embodiments may be combined with the locking surface angle 12 that is more than 90°, as disclosed in FIGS. 6*a* to 8*c*, to obtain an increased vertical locking in the position where the locking surface cooperates.

The invention claimed is:

1. A set of resilient floorboards, each floorboard provided with a mechanical locking system for vertical and horizontal locking to an adjacent floorboard, the mechanical locking system comprising a first device at a first edge, and a second device at a second edge, wherein the first device comprises a downwardly protruding locking element that locks the first edge vertically and horizontally with the second edge of the adjacent floorboard, and an upper upwardly resiliently bendable locking strip that forms a convex shape towards a bottom surface of the floorboard during locking, and the second device comprises a lower locking strip, wherein the downwardly protruding locking element comprises an outermost side facing the adjacent floorboard, and the outermost side is provided with a chamfered guiding surface configured to cooperate with an uppermost edge of the adjacent floorboard during locking, and wherein the outermost side of the downwardly protruding locking element comprises at least a first vertical wall adjacent an angled lower wall that angles inward toward the chamfered guiding surface directly from the first vertical wall, and the chamfered guiding surface is below the angled lower wall.

2. The set of resilient floorboards according to claim 1, wherein the lower locking strip of the second device is downwardly resiliently bendable.

3. The set of resilient floorboards according to claim 1, wherein the second device comprises an upwardly protruding locking element that locks the second edge vertically and horizontally with the first edge of the adjacent floorboard.

4. The set of resilient floorboards according to claim 1, wherein the floorboards are made of a thermoplastic material.

5. The set of resilient floorboards according to claim 3, wherein the downwardly protruding locking element is provided with a first locking surface configured to cooperate with a second locking surface of the upwardly protruding locking element for horizontal locking of adjacent floorboards.

6. The set of resilient floorboards according to claim 3, wherein the downwardly protruding locking element is provided with a first guiding surface configured to cooperate with the upwardly protruding locking element.

7. The set of resilient floorboards according to claim 6, wherein the upwardly protruding locking element is provided with a second guiding surface configured to cooperate with the first guiding surface.

8. The set of resilient floorboards according to claim 6, wherein the angle of the first guiding surface is more than about 30°.

9. The set of resilient floorboards according to claim 6, wherein the angle of the first guiding surface is more than about 45°.

10. The set of resilient floorboards according to claim 7, wherein the angle of the second guiding surface is more than about 30°.

11. The set of resilient floorboards according to claim 7, wherein the angle of the second guiding surface is more than about 45°.

12. The set of resilient floorboards according to claim 5, the angle between the first locking surface and the second locking surface and an upper surface of the floorboards is more than 90° to obtain a vertical locking in a position where the first locking surface and the second locking surface cooperate.

13. The set of resilient floorboards according to claim 1, wherein the first edge is provided with a tongue and the second edge is provided with a groove for vertical locking of the floorboards.

14. The set of resilient floorboards according to claim 1, wherein the first edge is provided with a groove and the second edge is provided with a tongue for vertical locking of the floorboards.

15. The set of resilient floorboards according to claim 1, wherein the upper upwardly resiliently bendable locking strip and the lower locking strip are integrally formed in the floorboard.

16. The set of resilient floorboards according to claim 1, wherein the floorboards are comprised of resilient material and the mechanical locking system is integrally formed in one piece with the resilient material of each floorboard.

17. The set of resilient floorboards according to claim 1, wherein a space is provided between a subfloor on which the floorboards are arranged and the lower locking strip.

18. A set of resilient floorboards, each floorboard comprising resilient material and provided with a mechanical locking system for vertical and horizontal locking to an adjacent floorboard, the mechanical locking system comprising a first device at a first edge, and a second device at a second edge, wherein the first device comprises a downwardly protruding locking element that locks the first edge vertically and horizontally with the second edge of the adjacent floorboard, and an upper upwardly resiliently bendable locking strip that forms a convex shape towards a bottom surface of the floorboard during locking, and the second device comprises a lower locking strip and an upwardly protruding locking element that locks the second edge vertically and horizontally with the first edge of the adjacent floorboard, wherein the mechanical locking system is integrally formed in one piece with the resilient material of the floorboard, wherein the downwardly protruding locking element comprises an outermost side facing the adjacent floorboard, and the outermost side is provided with a chamfered guiding surface configured to cooperate with an uppermost edge of the adjacent floorboard during locking, and wherein the outermost side of the downwardly protruding locking element comprises at least a first vertical wall adjacent an angled lower wall that angles inward toward the chamfered guiding surface directly from the first vertical wall, and the chamfered guiding surface is below the angled lower wall.

19. The set of resilient floorboards according to claim 18, wherein the lower locking strip of the second device is downwardly resiliently bendable.

20. A set of resilient floorboards, each floorboard provided with a mechanical locking system for vertical and horizontal locking to an adjacent floorboard, the mechanical locking system comprising a first device at a first edge, and a second device at a second edge, wherein the first device comprises a downwardly protruding locking element that locks the first edge vertically and horizontally with the second edge of the adjacent floorboard, and an upper upwardly resiliently bendable locking strip that forms a convex shape towards a bottom surface of the floorboard during locking, and the second device comprises a lower downwardly resiliently bendable locking strip and an upwardly protruding locking element that locks the second edge vertically and horizontally with the first edge of the adjacent floorboard, wherein the floorboards are made of a thermoplastic material, wherein the downwardly protruding locking element comprises an outermost side facing the adjacent floorboard, and the outermost side is provided with a chamfered guiding surface configured to cooperate with an uppermost edge of the adjacent floorboard during locking, and wherein the outermost side of the downwardly protruding locking element comprises at least a first vertical wall adjacent an angled lower wall that angles inward toward the chamfered guiding surface directly from the first vertical wall, and the chamfered guiding surface is below the angled lower wall.

* * * * *